US009956568B2

(12) United States Patent
O'Brien

(10) Patent No.: US 9,956,568 B2
(45) Date of Patent: May 1, 2018

(54) SKIRTBOARD PAINT GUARD

(71) Applicant: Amanda Jean O'Brien, Fredericksburg, VA (US)

(72) Inventor: Amanda Jean O'Brien, Fredericksburg, VA (US)

( * ) Notice: Subject to any disclaimer, the term of this patent is extended or adjusted under 35 U.S.C. 154(b) by 60 days.

(21) Appl. No.: 14/983,895

(22) Filed: Dec. 30, 2015

(65) Prior Publication Data

US 2017/0189925 A1 Jul. 6, 2017

(51) Int. Cl.
*B05B 15/04* (2006.01)
*B05C 21/00* (2006.01)

(52) U.S. Cl.
CPC ..... *B05B 15/04* (2013.01); *B05B 15/0475* (2013.01); *B05C 21/005* (2013.01)

(58) Field of Classification Search
None
See application file for complete search history.

(56) References Cited

U.S. PATENT DOCUMENTS 2,698,003 A * 12/1954 Bullock ..... B05B 15/0475 118/504
3,693,589 A * 9/1972 Knox ..... B05B 15/0493 118/504
4,258,654 A 3/1981 Ivankovich
8,334,041 B2 12/2012 Sweeney et al.
2008/0066389 A1 3/2008 Siegel

* cited by examiner

*Primary Examiner* — Jethro M Pence
(74) *Attorney, Agent, or Firm* — John D. Lee

(57) ABSTRACT

A paint guard for protecting a stair covering during the painting of a skirtboard on a staircase, the paint guard having a plurality of interconnected and generally perpendicular planar surfaces, including a surface for covering a portion of a stair tread, a surface for covering a portion of a stair riser, and a plurality of surfaces for covering the edges of the stair covering nearest the skirtboard. The paint guard also includes a concave portion attached to the surface for covering a portion of a stair tread, the concave portion covering a forward edge portion of a staircase tread. The paint guard is either rigidly made or constructed of a durable material that can be bent and folded into the final shape, and is adjustable in size to fit on staircases of varying dimension.

4 Claims, 8 Drawing Sheets

SKIRTBOARD PAINT GUARD

BACKGROUND OF THE INVENTION (1) Field of the Invention

The present invention relates to a skirtboard paint guard, more particularly, to a paint guard which is suitable to protect stair carpeting when painting the skirtboard on a staircase.

A skirtboard, as is known in the building trades, is a trimboard which runs with the rake, pitch or incline of the stair against a wall on a closed side of a staircase. While usually nonstructural, a skirtboard protects the drywall or other wall surface and adds to the decor of the staircase. It is often desirable to paint the skirtboard of a staircase at the same time as, or in a corresponding color with, other trim pieces on and around the staircase (for example, baseboard molding, chair rail molding, or crown molding).

When paint is applied to the skirtboard, whether by brush or roller or other means, it is necessary to protect the staircase itself from dripping, splattering, or splashing of the paint. This is important because the staircase surface material usually comprises carpeting or finished hardwood. It is laborious and often difficult to remove paint drips and splatters from these materials.

Moreover, both the risers (the vertical boards) and the treads (the horizontal boards) of the staircase must be protected from the paint applied to the skirtboard.

(2) Description of Related Art

Although various paint guards for baseboards have been proposed in the prior art, such as the paint guard disclosed by Ivankovich in U.S. Pat. No. 4,258,654, no paint guard designed specifically for the skirtboard of a staircase has been proposed.

Prior art devices for protecting the staircase surface when painting a skirtboard include the use of painter's tape and/or the use of a trowel (a flat piece of metal or plastic).

Painter's tape is labor intensive, as several strips must often be applied in order to obtain the necessary width of protective coverage. The tape must be applied to both the risers and the treads, adding more time and effort. When painter's tape is removed upon completion of the staircase painting job, it very often is messy and introduces paint drips onto the surface being protected.

Trowel usage requires the use of one of the painter's hands for placement, leaving only the remaining hand for all other tasks related to the painting. The trowel must continuously be moved from a horizontal to a vertical orientation because of the presence of both riser boards and tread boards. It must accordingly be continually cleaned or wiped free from paint as it is moved from one orientation to the other.

BRIEF SUMMARY OF THE INVENTION

It is thus an object of the present invention to provide a skirtboard paint guard which is easy to use and which overcomes the disadvantages of the prior art paint guard devices.

It is a further object of the present invention to provide a skirtboard paint guard which will protect the stair surface while painting the skirtboard on a staircase, and which can be quickly moved from one step to the next of the staircase.

It is a still further object of the present invention to provide a skirtboard paint guard which can be quickly and easily removed from the staircase after painting, quickly and easily cleaned, and then reused in another painting application.

In accordance with the present invention, a skirtboard paint guard is provided for protecting the surface material of the risers and treads of a staircase when painting the skirtboard of the staircase. The skirtboard paint guard of the present invention comprises a unitary structure having a horizontal component, a vertical component, and a curved component. The horizontal component, which comprises the greatest amount of surface area of the paint guard device, is designed to lie flat on the surface of a tread of the staircase being painted. The vertical component is designed to fit flat against the surface of a riser of the staircase, while the curved component is designed to cover the surface of a front lip of the tread. The paint guard components covering the tread and the riser also include, respectively, perpendicularly oriented portions for protruding downwardly along the edge of the staircase surface material (for example, carpeting). The unitary structure is thus designed to fit tightly against the skirtboard being painted.

After placement, the portion of the skirtboard adjacent to the tread, riser and lip covered by the paint guard is painted with no dripping, splattering, or splashing of paint onto the respective surfaces of the tread, riser, and lip. The skirtboard paint guard is then moved to the next tread/riser/lip of the staircase and the process repeated. Alternatively, a plurality of the inventive skirtboard paint guards are used, one placed on each tread/riser/lip of the staircase, so that the entire length of the staircase skirtboard can be painted at once.

In a particularly preferred embodiment, the skirtboard paint guard includes a small tab or roughened surface area on the side of the horizontal component farthest from the skirtboard being painted. This feature allows the painter to gently tug on the paint guard, creating a small gap to ensure complete paint coverage between the skirtboard and the covering material of the staircase.

In another particularly preferred embodiment, the skirtboard paint guard includes an adjustable feature to accommodate staircase treads of any depth. In this preferred embodiment, the horizontal component of the paint guard receives an insert which is slidably adjusted to any desired length. The insert is tightly received in slots formed on the underside of the horizontal component. The insert is frictionally held in place after being adjusted to the desired length. The skirtboard paint guard can thus be used on any staircase, regardless of the depth of the tread thereof.

In another particularly preferred embodiment, the skirtboard paint guard includes an adjustable feature to accommodate staircase risers of any height. In this preferred embodiment, the vertical component of the paint guard includes a plurality of scored lines across its width so that the user may break off a portion of the vertical component to match the height of the riser.

In yet another particularly preferred embodiment, the skirtboard paint guard is formed as a single structure having a plurality of scored lines which allow the user to bend the various paint guard components into the shape of the staircase, allowing its use on any staircase, regardless of specific dimensions of tread depth and/or riser height. According to this particularly preferred embodiment, the vertical component is bent upwardly into place, the curved component is bent downwardly into place, and the perpendicularly oriented portions are bent downwardly from the other components into place. The customized paint guard is then placed on the stair covering of the staircase.

The skirtboard paint guard according to the present invention therefore allows a painter to quickly and easily prepare and paint the skirtboard of any staircase without concern for dripping, splattering, or splashing of the paint onto the staircase surface (such as carpeting). In addition, the time for preparation of the staircase is greatly reduced compared to conventional methods such as taping.

BRIEF DESCRIPTION OF THE SEVERAL VIEWS OF THE DRAWINGS

Other aspects and advantages of this invention will become apparent from the following more detailed description which refers to the accompanying drawings, in which.

Figure 1:
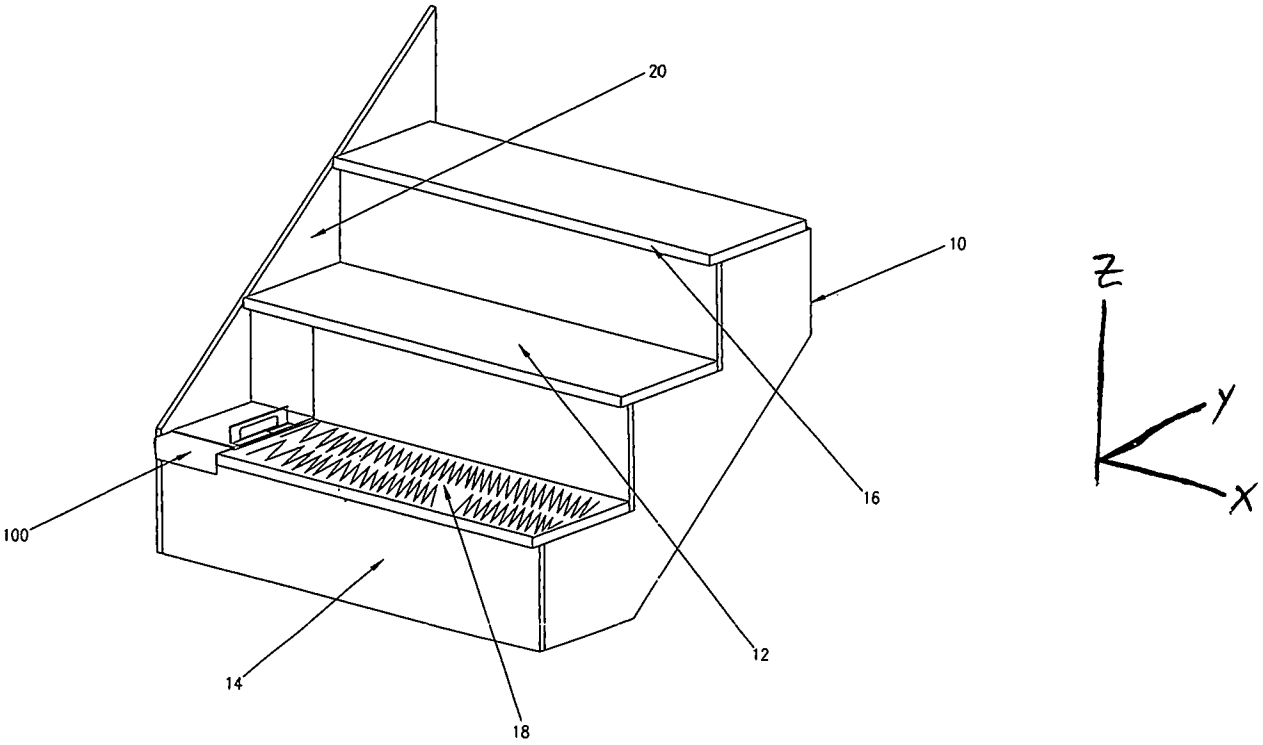
FIG. 1 is a front view of a typical staircase, showing a skirtboard and staircase covering thereof, along with a skirtboard paint guard according to the present invention in place.

Note that all of the embodiments illustrated in the drawings are presented with respect to a conventional X-Y-Z three dimensional Cartesian coordinate system, in which each of the dimensions X, Y, and Z is perpendicular to the other two dimensions. Such a three dimensional Cartesian coordinate system is conventional and well known in the art.

DETAILED DESCRIPTION OF THE INVENTION

As illustrated in FIG. 1, a staircase 10 provides access between different levels of a house, apartment, or similar building structure. The staircase 10 consists of a series of steps, each step being formed with a tread 12 and a riser 14. The series of treads 12 and risers 14 provide a walking pathway for an individual to easily move between the bottom level of the staircase 10 and the top level thereof.

The width of a staircase tread 12 extends in the X direction, while the depth of a staircase tread 12 extends in the Y direction. The staircase tread 12 thus lies in the X-Y plane. The thickness of staircase tread 12 extends in the Z direction. The width of a staircase riser 14 extends in the X direction, while the height of a staircase riser 14 extends in the Z direction. The staircase riser 14 thus lies in the X-Z plane. The thickness of staircase riser 14 extends in the Y direction.

To provide for reasonable ease in traversing the steps of a staircase, standards have been developed governing the depth of a staircase tread 12 and the height of a staircase riser 14. These standards vary slightly with locale, but generally require the tread depth to range from 12 to 15 inches, and the riser height to range from 7 to 9 inches. A rule of thumb for building a staircase is that the sum of a tread depth and its two adjacent risers should be between 24 and 26 inches.

The staircase 10 is often provided with a skirtboard on one or both sides for decorative and/or structural reasons. In the illustration of FIG. 1, the skirtboard 20 is provided on the left side of staircase 10, but can be provided on both sides if desired. While the main portions of the staircase 10 are usually provided with a covering material 18, such as carpeting, the skirtboards 20 remain covering-free, and thus require occasional painting in the same manner as other baseboards, moldings, and trim. The skirtboard 20 to be painted lies in the Y-Z plane, and has a thickness extending in the X direction.

The covering material (carpet) 18 runs continuously from the top to the bottom of the staircase 10, and forms a rounded edge or nose 16 as it traverses the outer edge of each tread 12. When the skirtboard 20 is painted, all of the adjacent covering material (carpet) 18 must be protected from dripping, splattering, or splashing of the paint. This includes the material (carpet) 18 covering the treads 12, the risers 14, and the noses 16.

A paint guard 100 is placed onto a portion of the staircase 10 for this purpose. As seen in FIG. 1, paint guard 100 is placed onto a side of staircase 10 nearest a skirtboard 20. Paint guard 100 covers a tread 12, a riser 14, and a nose 16. After painting the section of skirtboard 20 adjacent paint guard 100, the paint guard 100 is moved to the next tread/riser/nose sequence. The paint guard 100 is thus sequentially moved until the entire skirtboard 20 is painted. Alternatively, a plurality of paint guards 100 may be placed on the staircase 10 simultaneously in order to protect covering material (carpet) 18 along the entire span of staircase 10. This arrangement allows the painting of the entirety of skirtboard 20 to proceed uninterrupted.

Figure 2:
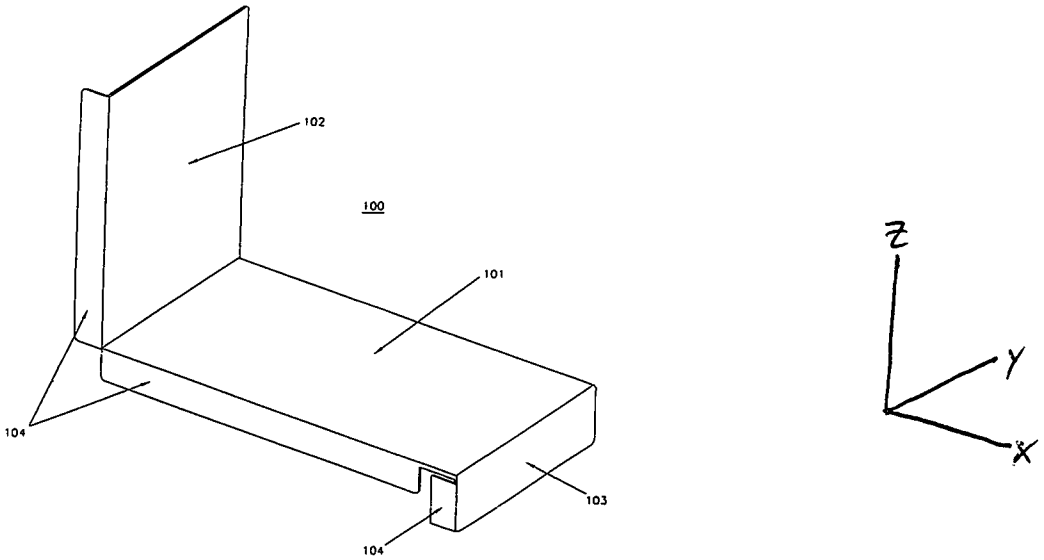
FIG. 2 is a perspective view of a first embodiment of the present invention.

Referring to FIG. 2, paint guard 100 is shown in greater detail. Paint guard 100 is a unitary structure comprising three major planar surfaces arranged generally perpendicularly. Each of these three major surfaces has a thickness sufficient to provide rigidity to the structure, but the thickness is negligible for purposes of description. The first major surface, tread plate 101, covers a portion of covering material (carpet) 18 on tread 12 of staircase 10 nearest skirtboard 20. Tread plate 101 lies in the X-Y plane, as shown. The second major surface, riser plate 102, covers a portion of covering material (carpet) 18 on riser 14 of staircase 10 nearest skirtboard 20. Riser plate 102 lies in the Y-Z plane, as shown. The third major surface, nose plate 103, covers the nose 16 of covering material (carpet) 18 on the outer edge of tread 12 nearest skirtboard 20. Nose plate 103 lies in the Y-Z plane, as shown.

Paint guard 100 further comprises three minor planar surfaces formed as perpendicular extensions of the three major planar surfaces. As illustrated in FIG. 2, the three minor surfaces are labeled as side plates 104, extending perpendicularly, respectively, from tread plate 101, riser plate 102, and nose plate 103. Each of the side plates 104 lies in the X-Z plane, as shown. Like the major surfaces, each of these three minor surfaces has a thickness sufficient to provide rigidity to the structure, but the thickness is negligible for purposes of description. Side plates 104 provide additional protection for covering material (carpet) 18, as the side plates 104 penetrate the gap between the covering material (carpet) 18 and the skirtboard 20. The presence of side plates 104 on paint guard 100 allows painting of skirtboard 20 completely to the bottom thereof without any paint drips or splatters getting on covering material (carpet) 18.

Figure 3:
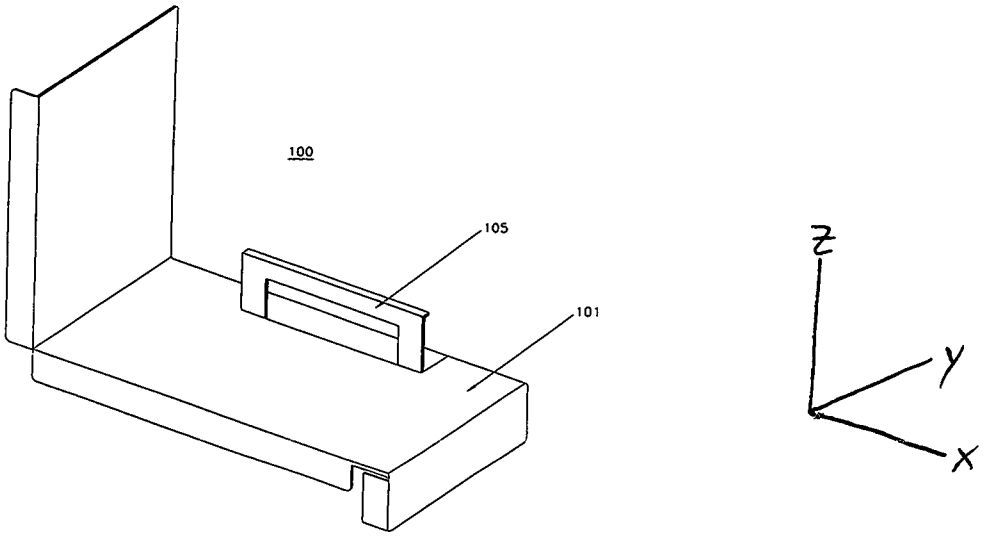
FIG. 3 is a perspective view of a second embodiment of the present invention.

Referring to FIG. 3, in order to facilitate painting of skirtboard 20 completely to the bottom thereof as just described, a pull feature 105 is integrally formed on tread plate 101 of paint guard 100. Pull feature 105 is formed on tread plate 101 near the edge of tread plate 101 farthest from side plates 104 at any point along that edge. Pull feature 105 allows a user to give a gentle tug on paint guard 100, thus pulling covering material (carpet) 18 away from skirtboard 20 by means of side plates 104. This feature allows the user to easily and quickly paint skirtboard 20 completely to the bottom thereof without any paint drips or splatters getting on covering material (carpet) 18.

The pull feature 105 is illustrated in FIG. 3 as a tab oriented perpendicularly to the surface of tread plate 101, the tab having a negligible thickness (for purposes of discussion) and lying in the X-Z plane. Alternative implementations for the pull feature 105 are possible, however. One such alternative implementation is the roughening of a portion of the surface area of tread plate 101 in the general vicinity of where pull feature 105 is shown. By having the surface area roughened in this vicinity, a user's finger can gently tug on the paint guard 100 by means of friction between the finger and the roughened surface area, thus moving the paint guard 100 and pulling covering material (carpet) 18 away from skirtboard 20 by means of side plates 104.

Figure 4:
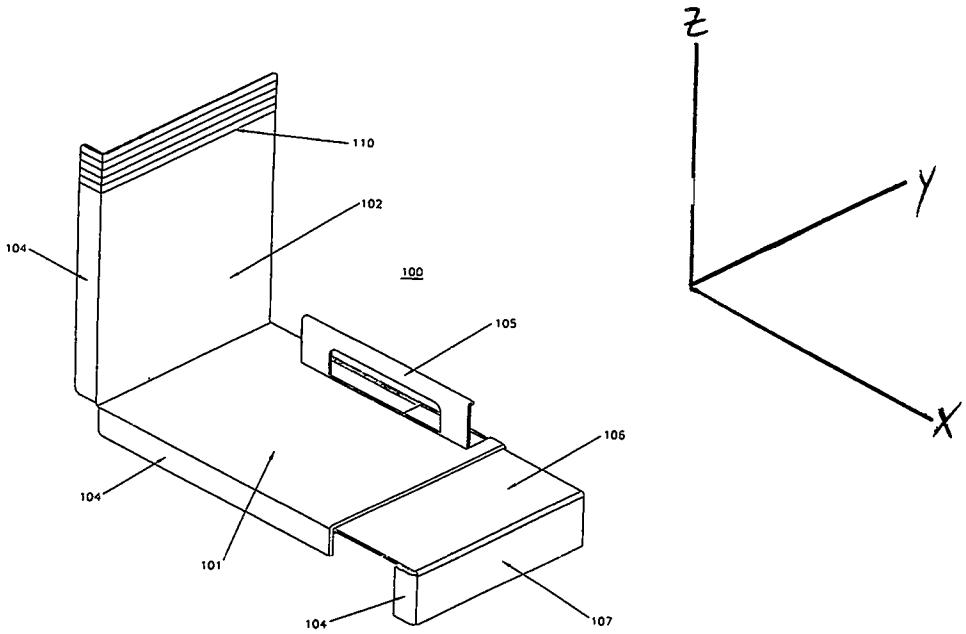
FIG. 4 is a top perspective view of a third embodiment of the present invention showing the adjustable insert in an extended position.

Referring now to FIG. 4, an adjustable embodiment of paint guard 100 is illustrated. As mentioned earlier, depending on locality, there may be variations in the depth of treads 12 of staircase 10, as well as variations in the height of risers 14 of staircase 10. In order to accommodate these variations, tread plate 101 and riser plate 102 are adjustable.

Figure 5:
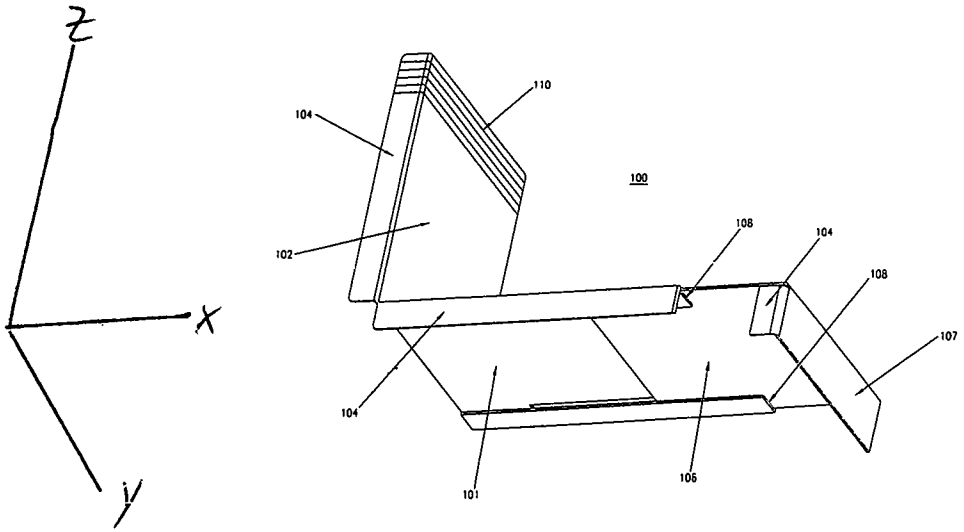
FIG. 5 is a bottom perspective view of a third embodiment of the present invention showing the adjustable insert in an extended position.
Figure 6:
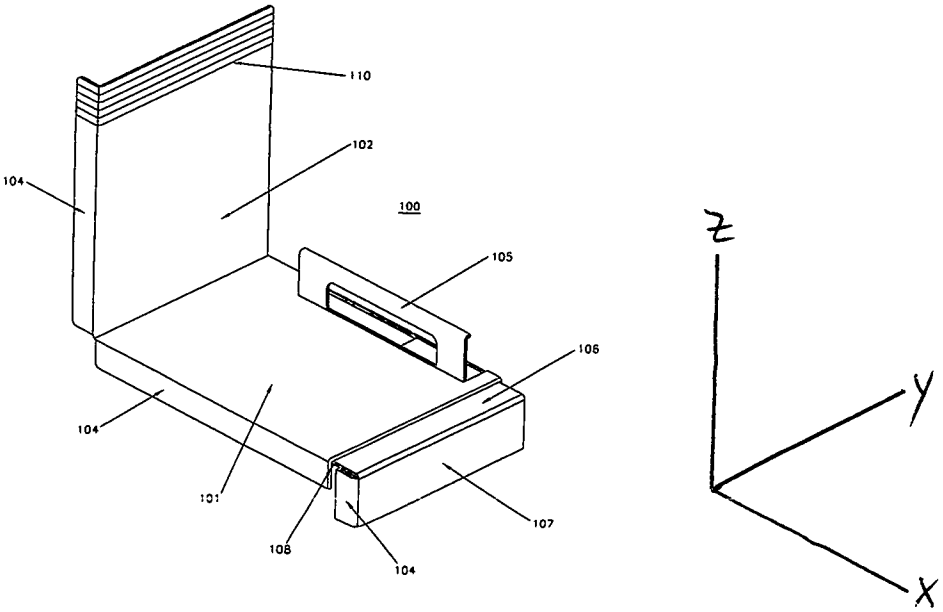
FIG. 6 is a top perspective view of a third embodiment of the present invention showing the adjustable insert in a retracted position.

As illustrated in FIGS. 4-6, nose plate 103 of the previously described embodiments is replaced by an adjustable sliding arrangement allowing for variations in depth of the tread 12 of staircase 10 being covered. Sliding insert 106 is received in a pair of slots 108 formed on the underside of tread plate 101. The dimensions of slots 108 and the thickness of sliding insert 106 are determined so that a tight fit is achieved, sliding insert 106 being held in a desired position through frictional engagement with slots 108 and the underside of tread plate 101. This allows the user to cover a tread 12 of any particular depth.

Sliding insert 106 is provided with its own nose plate, identified as nose plate 107 in FIG. 4. Sliding insert 106 is also provided with a side plate 104 which aligns with side plate 104 of tread plate 101 to allow painting of skirtboard 20 completely to the bottom thereof without any paint drips or splatters getting on covering material (carpet) 18. FIGS. 4 and 5 illustrate sliding insert 106 in an extended position, whereas FIG. 6 illustrates sliding insert 106 in a retracted position.

Referring once again to FIG. 4, riser plate 102 is provided with a series of breakoff lines 110 extending completely across riser plate 102 and associated side plate 104. Lines 110 are preferably scored into the material of which paint guard 100 is formed, but may also consist of perforations into the material. In either case, a user can bend and break off a length of riser plate 102 and side plate 104 such that the height of riser plate 102 and side plate 104 then equals the height of riser 14 of staircase 10. This feature allows the user to cover a riser 14 of any particular height.

The combination of the adjustable sliding insert 106 on tread plate 101 and the series of breakoff lines 110 on riser plate 102 allows the paint guard 100 to be usable for staircase tread/riser arrangements of any particular dimensions.

Figure 7A:
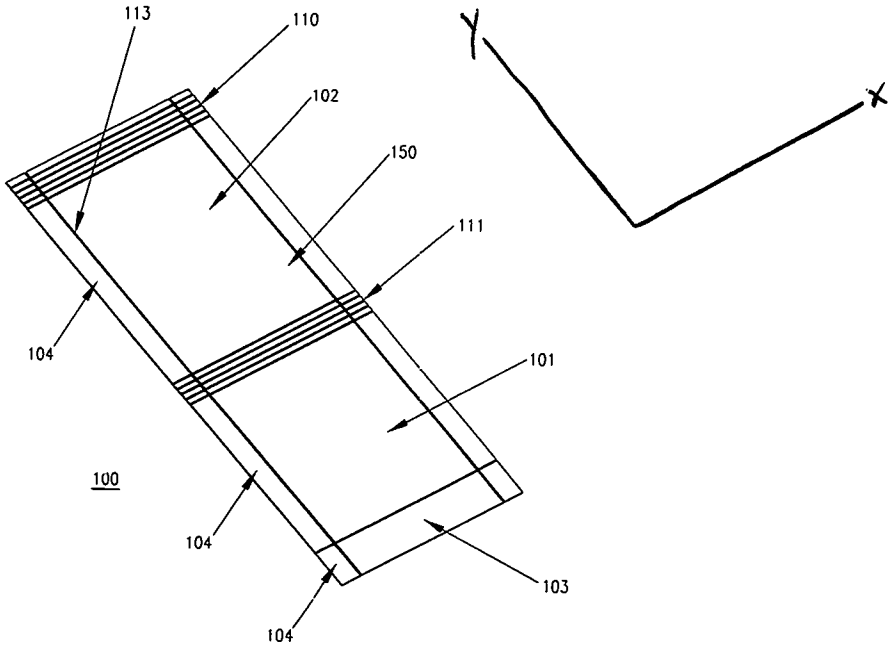
FIG. 7A is a perspective view of a fourth embodiment of the present invention prior to assembly by a user.
Figure 7B:
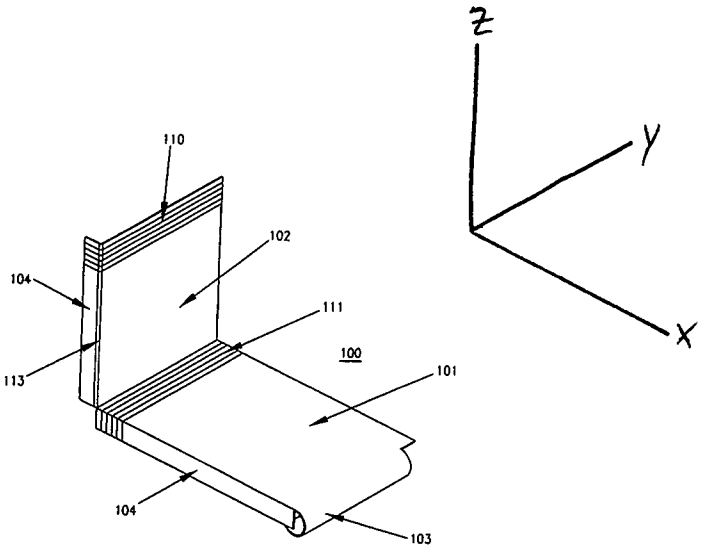
FIG. 7B is a perspective view of a fourth embodiment of the present invention after assembly by a user.

Turning now to FIGS. 7A and 7B, a paint guard 100 comprises a sheet of material 150 which is flat and planar except for a generally half-tubular nose plate 103 formed on one end thereof. The half-tubular geometry of nose-plate 103 can best be seen in FIG. 7B. In FIG. 7A nose plate 103 is on the lower end of the sheet of material 150. The sheet material 150 is very thin so that it lies within the X-Y plane. The description of the various portion formed on sheet material 150 therefore refer only to portions lying in the X-Y plane. A series of scored or perforated breakoff lines 110 are formed on the sheet of material 150 at the end of the sheet farthest from nose plate 103. As will be explained further, these breakoff lines 110 allow adjustment for a riser 14 of any particular height. A series of scored or perforated bend lines 111 are also formed on the sheet of material 150 intermediate the nose plate 103 and the series of lines 110. As will be explained further, these bend lines 111 allow adjustment for a tread 12 of any particular depth. A scored or perforated bend line 113 is formed on the sheet of material 150 perpendicular to the series of lines 110 and 111. The bend line 113 extends along the entire length of the sheet of material 150. As will be explained further, bend line 113 provides for formation of the side plates 104 of the paint guard 100.

The sheet of material 150 may comprise a very thin metal, various types of plastic or vinyl materials, or even a thin cardboard. Any material that can be scored or perforated, bent into the appropriate shape, and then remain relatively rigid after bending and shaping, is suitable for use in the present invention. The description herein is not intended to be limited to the use of any particular material, but is rather intended to encompass all suitable materials.

To quickly and easily transform the sheet of material 150 into a paint guard ready for placement on the covering material (carpet) 18 of a staircase 10, a user first bends the sheet of material 150 along a selected one of the series of bend lines 111 to form a generally L-shaped structure (as shown in FIG. 7B). The particular one of the series of bend lines 111 is selected in accordance with the depth of the tread 12 of the staircase 10 being painted. The portion of the selected bend line which traverses the portion of sheet of material 150 that will become side plates 104 is then cut so that side plates 104 can later be bent into position.

Next the user determines the height of the riser 14 of the staircase 10 being painted, and selects one of the series of breakoff lines 110 that corresponds to that height. In other words, the distance between the previously selected one of the series of bend lines 111 and the selected breakoff line 110 will cause riser plate 102 of the paint guard 100 to correspond to the height of the riser 14 of staircase 10. The user bends the sheet of material 150 on the selected breakoff line 110 until the excess length of material breaks completely off. The excess material is discarded.

The user then bends side plates 104 into position by bending the sheet of material 150 along bend line 113. Each side plate 104 is bent downwardly in FIG. 7A into an orientation that is generally perpendicular to the plane of tread plate 101 and riser plate 102, respectively (that is, the X-Y plane in FIG. 7A). Note that the smallest side plate 104 associated with nose plate 103 may be pre-formed so that it does not need to be bent into position by the user.

FIG. 7B illustrates paint guard 100 after the user has performed the bending and cutting steps just described. The device can then be placed onto the covering material (carpet) 18 of a staircase 10 as described with respect to earlier embodiments. Tread plate 101 protectively covers tread 12 of staircase 10; riser plate 102 protectively covers riser 14 of staircase 10; nose plate 103 protectively covers nose 16 of covering material (carpet) 18 on staircase 10; and side plates 104 protectively cover the edges of the covering material (carpet) 18 closest to skirtboard 20 of staircase 10.

For a staircase upon which the paint guard of FIG. 7B is placed, the width of a staircase tread extends in the Y direction, while the depth of a staircase tread extends in the X direction. The staircase tread thus lies in the X-Y plane. The width of a staircase riser extends in the Y direction, while the height of a staircase riser extends in the Z direction. The staircase riser thus lies in the Y-Z plane. In the final formed product of FIG. 7B, tread plate 101 thus lies in the X-Y plane; riser plate 102 lies in the Y-Z plane; and side plates 104 each lie in the X-Z plane.

FIGS. 7A and 7B show paint guard 100 with the side plates 104 formed on the left side of the apparatus (as viewed in the Figures) for painting the left-hand side of staircase 10. The invention described and claimed herein is intended to encompass, however, embodiments which are mirror formed for painting the right-hand side of staircase 10. In addition, paint guard 100 can be implemented in a sheet of material 150 with both left-hand and right-hand sections thereon, allowing the user to select between left-hand and right-hand orientations.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

The embodiments of the invention in which an exclusive property or privilege is claimed are defined in the following claims.

The invention claimed is:

1. An article of manufacture designed to be used as a paint guard for protecting a stair covering during the painting of a skirtboard on a staircase, the staircase including a plurality of staircase treads and staircase risers, the article of manufacture comprising a planar sheet of material shaped as a rectangle, the rectangle having a first dimension in an X direction and a second dimension in a Y direction, the X direction being perpendicular to the Y direction, the planar sheet of material including:

a rectangular tread plate section having a first dimension in the X direction which is less than the first dimension of the rectangle, and a second dimension in the Y direction which is less than the second dimension of the rectangle;

a rectangular riser plate section adjoining the tread plate section along the first dimension of the rectangle, the riser plate section having a first dimension in the X direction equal to the first dimension of the tread plate section, and a second dimension in the Y direction which is less than the second dimension of the rectangle;

a first plurality of parallel indentations extending completely across the planar sheet of material between the tread plate section and the riser plate section, said plurality of indentations being parallel to the first dimension of the rectangle in the X direction;

a nose plate section attached to the tread plate section along the entire first dimension of the tread plate section at the portion thereof farthest from the riser plate section, the nose plate section having a first dimension in the X direction equal to the first dimension of the tread plate section and a second dimension in the Y direction which is less than the second dimension of the tread plate section;

a first pair of planar, rectangular side plate sections attached to the tread plate section along the entire second dimension of the tread plate section in the Y direction on each side thereof, the first pair of side plate sections each having a respective first dimension in the X direction that is less than the first dimension of the tread plate section and a respective second dimension in the Y direction equal to the second dimension of the tread plate section;

a second pair of planar, rectangular side plate sections attached to the riser plate section along the entire second dimension of the riser plate section in the Y direction on each side thereof, the second pair of side plate sections each having a respective first dimension in the X direction that is less than the first dimension of the riser plate section and a respective second dimension in the Y direction equal to the second dimension of the riser plate section;

a third pair of planar, rectangular side plate sections attached to the nose plate section along the entire second dimension of the nose plate section in the Y direction on each side thereof, the third pair of side plate sections each having a respective first dimension in the X direction that is less than the first dimension of the nose plate section and a respective second dimension in the Y direction equal to the second dimension of the nose plate section; and a second plurality of parallel breakoff indentations extending completely across the riser plate section and the second pair of side plate sections at the portions of said second pair of side plate sections farthest from the nose plate section, said plurality of breakoff indentations being parallel to the first dimension of the rectangle in the X direction.

2. The article of manufacture of claim 1, wherein said nose plate section has a concave curvature.

3. The article of manufacture of claim 2, wherein said third pair of planar side plate sections attached to the nose plate section along the second dimension of the nose plate section on each side thereof each has a concave curvature matching the concave curvature of the nose plate section.

4. The article of manufacture of claim 1, wherein a portion of the surface of the tread plate section is roughened.

* * * * *